US010624524B2

(12) United States Patent
Kim et al.

(10) Patent No.: US 10,624,524 B2
(45) Date of Patent: Apr. 21, 2020

(54) SHOCK ABSORBER AND DISHWASHER INCLUDING THE SAME

(71) Applicant: LG Electronics Inc., Seoul (KR)

(72) Inventors: Daehee Kim, Seoul (KR); Myungwon Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/852,976

(22) Filed: Dec. 22, 2017

(65) Prior Publication Data

US 2018/0177379 A1 Jun. 28, 2018

(30) Foreign Application Priority Data

Dec. 27, 2016 (KR) ..... 10-2016-0179747

(51) Int. Cl.
*A47L 15/50* (2006.01)
*A47L 15/42* (2006.01)
*A47L 15/22* (2006.01)

(52) U.S. Cl.
CPC ..... *A47L 15/505* (2013.01); *A47L 15/22* (2013.01); *A47L 15/4257* (2013.01); *A47L 15/50* (2013.01); *A47L 15/507* (2013.01)

(58) Field of Classification Search
CPC ..... A47L 15/22; A47L 15/50; A47L 15/505; A47L 15/507; A47L 15/4257
USPC ..... 312/228, 228.1, 311
See application file for complete search history.

(56) References Cited

U.S. PATENT DOCUMENTS 4,226,490 A 10/1980 Jenkins
4,605,265 A * 8/1986 Bessinger ..... A47B 88/944 384/20
4,917,248 A * 4/1990 Friskney ..... A47L 15/503 211/184
5,409,309 A * 4/1995 Giddings ..... A47L 15/507 134/201
5,876,103 A * 3/1999 Domenig ..... A47B 88/487 312/334.4

(Continued)

FOREIGN PATENT DOCUMENTS

DE 2805627 A1 8/1979
DE 102010043268 5/2012

(Continued)

OTHER PUBLICATIONS

European Extended Search Report in European Application No. 17208299.2, dated Jul. 3, 2018.

(Continued)

*Primary Examiner* — James O Hansen
(74) *Attorney, Agent, or Firm* — Fish & Richardson P.C.

(57) ABSTRACT

A shock absorber and a dishwasher including the same are disclosed. The dishwasher includes a tub having a dish introduction port formed in a front surface thereof, a door for opening and closing the dish introduction port and a rack having moving casters so as to be drawn out of and introduced into the tub, dishes being placed on the rack, and the shock absorber is disposed between the tub of the dishwasher and the rack and includes a body, a receiving groove formed in one side surface of the body so as to receive a portion of the rack, and a pressing portion provided on a remaining surface of the body so as to press and support a portion of the tub to thus press the body downwards.

11 Claims, 8 Drawing Sheets

(56) References Cited

U.S. PATENT DOCUMENTS

| | | | | |
|---|---|---|---|---|
| 7,984,812 | B2 * | 7/2011 | Pike | A47L 15/503 211/41.9 |
| 2013/0328463 | A1 * | 12/2013 | Tarcy | A47L 15/50 312/228 |

FOREIGN PATENT DOCUMENTS

| | | | |
|---|---|---|---|
| KR | 1020050123192 | | 12/2005 |
| WO | WO2006052096 | A1 | 5/2006 |

OTHER PUBLICATIONS

Partial European Search Report in European Application No. 17208299.2, dated Apr. 25, 2018, 15 pages.

* cited by examiner

SHOCK ABSORBER AND DISHWASHER INCLUDING THE SAME

Pursuant to 35 U.S.C. § 119(a), this application claims the benefit of Korean Patent Application No. 10-2016-0179747, filed on Dec. 27, 2016, which is hereby incorporated by reference as if fully set forth herein.

BACKGROUND OF THE INVENTION

Field of the Invention

The present invention relates to a shock absorber and a dishwasher including the same, and more particularly to a shock absorber intended to prevent unintended movement of a rack in the dishwasher and the occurrence of scratches on the inner surface of a door, and a dishwasher including the shock absorber.

Discussion of the Related Art

Generally, a dishwasher is an apparatus that sprays high-pressure wash water onto dishes received therein to wash the dishes and dries the washed dishes. Specifically, the dishwasher is operated such that high-pressure wash water is sprayed into a tub, in which dishes are received, and the sprayed wash water removes foreign matter, such as food waste, from the surfaces of the dishes.

A dishwasher includes a case having a door coupled thereto, a tub provided in the case, a rack configured to be drawn out of and introduced into the tub and to support dishes mounted thereon, wash nozzles provided below the rack in the tub so as to spray wash water, a pump for pumping wash water to the wash nozzles, and a detergent box provided on the door so as to receive detergent therein.

In this kind of dishwasher, the rack is configured to be drawn forward out of the tub. Hence, movement of the rack occurs due to external force, which is generated during movement of the dishwasher, such as vibration, falling, or overturning of the dishwasher. As a result, the inner surface of the door, which is located close to the rack, become scratched, which makes it difficult to draw the rack out of the tub.

To overcome this problem, a foamed shock absorber is conventionally disposed between the rack and the inner surface of the door. However, since the foamed shock absorber comes into contact with the inner surface of the door, there is a problem in that it is impossible to fundamentally prevent the occurrence of scratches on the inner surface of the door.

To overcome this disadvantage, an additional member for preventing the occurrence of scratches, such as a member made of a different PE material, is attached to the foamed shock absorber. There is a problem with this solution in that the different member for preventing the occurrence of scratches tends to become separated from the foamed shock absorber during transportation.

In addition, there is another problem whereby the foamed shock absorber is broken or separated from the rack during transportation after packaging of the dishwasher, whereby the essential function of the rack packaging material is lost.

Furthermore, when a conventional foamed shock absorber having a large or fixed thickness is disposed between a rack having a variable size and the inner surface of the door, there is a problem in that the door of the dishwasher cannot be closed.

In a typical dishwasher, among an upper rack and a lower rack in the dishwasher, the lower rack is supported by a pair of rails provided on both lateral side walls of the tub, and is prevented from being moved upward by means of a pair of protrusions provided in a partial section of each of the rails. In the dishwasher, when strong external force is applied to the dishwasher during transportation, partial deformation of the tub, such as an increase in width between the two lateral side walls in part of the tub, may be created, and the distance between the pair of protrusions and the distance between the pair of rails may be increased. In this case, the moving casters of the rack may be separated upward beyond the pair of protrusions or downward from the pair of rails, thereby causing a problem in which the inner surface of the tub is scratched due to collision with the rack.

SUMMARY OF THE INVENTION

Accordingly, the present invention is directed to a shock absorber and a dishwasher including the same, which substantially obviate one or more problems due to limitations and disadvantages of the related art.

An object of the present invention is to provide a shock absorber and a dishwasher including the shock absorber, in which the shock absorber is firmly coupled to a rack in the dishwasher and thus there is no concern of the shock absorber being separated from the rack during transportation.

Another object of the present invention is to provide a shock absorber and a dishwasher including the shock absorber, in which the shock absorber is coupled to a lateral side surface of a rack in the dishwasher so as to fundamentally prevent the occurrence of scratches on the inner surface of the door of the dishwasher.

A further object of the present invention is to provide a shock absorber and a dishwasher including the shock absorber, in which one surface of the shock absorber, which comes into contact with the inner surface of the door of the dishwasher, is made of soft material so as to minimize the occurrence of scratches on the inner surface of the door and the other surface of the shock absorber is made of rigid material having the rigidity required of the shock absorber.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a shock absorber for a dishwasher having a tub and a rack provided inside the tub, the shock absorber comprising a body; one or more receiving grooves in a first side surface of the body, the one or more receiving grooves configured to receive a portion of the rack; and a pressing portion provided on a second side surface of the body opposite to the first side surface, the pressing portion configured to exert a downward force on the body in response to being pressed against a portion of the tub.

The rack may comprise moving casters configured to facilitate a movement of the rack, the tub may comprise a separation-prevention member protruding from an inner surface of the tub, the separation-prevention member configured to confine a movement of the moving casters in an upward direction and to contact the pressing portion, and the pressing portion may be configured to press a lower portion of the separation-prevention member in the upward direction.

The pressing portion may comprise an upper inclined surface provided at an upper portion of the pressing portion, the upper inclined surface extending outwardly and downwardly from the second side surface of the body.

The tub may further comprise a guide rail configured to guide the moving casters, and the pressing portion may further comprise a mounting surface provided at a lower portion of the pressing portion, the mounting surface configured to be mounted on the guide rail; and a lower inclined surface extending inwardly and downwardly from the mounting surface toward the first side surface of the body.

The one or more receiving grooves may be at least two receiving grooves, and the at least two receiving grooves are configured to restrict rotation of the body.

The rack may comprise a plurality of wires arranged in a moving direction of the rack, and the at least two receiving grooves are configured to receive the plurality of wires.

The first side surface of the body may comprise a first inner surface; and a second inner surface protruding further from the second side surface than the first inner surface, and the at least two receiving grooves may comprise: a first receiving groove on the first inner surface; and a second receiving groove on the second inner surface.

The first inner surface may be positioned higher than the second inner surface.

The body may comprise a guide surface extending from an upper end of the second inner surface toward the first inner surface, and the guide surface provides a lower surface of the first receiving groove.

Each of the one or more receiving grooves may comprise a support, protruding from an upper surface or a lower surface at an entrance of the receiving grooves, the support configured to mechanically support the lower surface or the upper surface.

In another aspect of the present invention, the present invention provides a shock absorber for a dishwasher having a tub and a rack provided inside the tub, the shock absorber comprising: a body comprising a first body layer having flexibility and configured to surround a portion of the rack and to contact the rack on a first side thereof and a second body layer attached to a second side of the first body layer opposite to the first side; a coupling hook provided at a first end of the body; a coupling leg provided at a second end of the body opposite to the first end and comprising a coupling hole configured to receive and couple to the coupling hook; and a plurality of shock-absorbing legs provided at the second end of the body and configured to independently couple to the rack.

The second body layer may comprise a second material that is softer than a first material of the first body layer.

Each of the plurality of shock-absorbing legs may comprise an inner surface configured to contact the rack; and an outer surface opposite to the inner surface, the outer surface comprises a second material that is softer than a first material of the inner surface.

The plurality of shock-absorbing legs may comprise a first shock-absorbing leg and a second shock-absorbing leg, the coupling leg may be positioned between the first shock-absorbing leg and the second shock-absorbing leg.

In a further aspect of the present invention, the present invention provides a dishwasher comprising a tub; a rack provided inside the tub, the rack comprising moving casters configured to facilitate a movement of the rack; and a shock absorber disposed between the tub and the rack, the shock absorber comprising: a body; one or more receiving grooves formed in a first side surface of the body, the one or more receiving grooves configured to receive a portion of the rack; and a pressing portion provided on a second side surface of the body opposite to the first side surface, the pressing portion configured to exert a downward force on the body in response to being pressed against a portion of the tub.

The tub may comprise a guide rail configured to guide the moving casters; and a separation-prevention member protruding from an inner surface of the tub, the separation-prevention member configured to confine a movement of the moving casters in an upward direction and to contact the pressing portion.

The first side surface of the body may comprise a first inner surface and a second inner surface protruding further from the second side surface than the first inner surface, and the one or more receiving grooves may comprise a first receiving groove on the first inner surface and a second receiving groove on the second inner surface.

The body may comprise a guide surface extending from an upper end of the second inner surface toward the first inner surface, and the guide surface may provide a lower surface of the first receiving groove.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
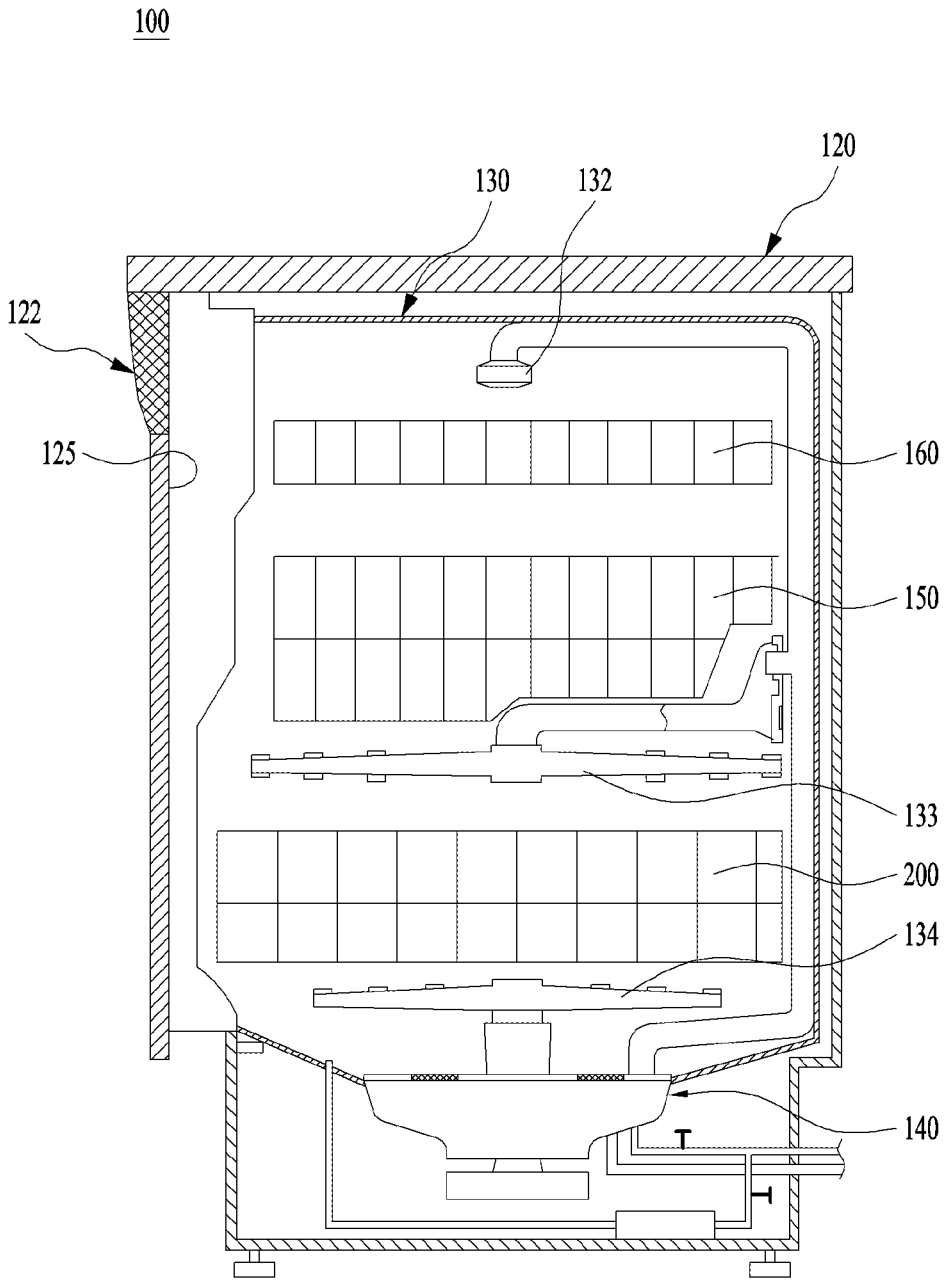
FIG. 1 is a schematic view diagrammatically illustrating the internal structure of a dishwasher according to an embodiment of the present invention.

Various embodiments of the present invention will now be described in detail with reference to the accompanying drawings. It will be understood that the embodiments of the present invention are disclosed illustratively for the purpose of helping convey a more comprehensive understanding of the present invention and that the present invention may be practiced in various modified forms other than the embodiments mentioned herein. In the following description of the present invention, detailed descriptions of known functions and components incorporated herein will be omitted when it may make the subject matter of the present invention unclear. For clarity of description, the sizes of some components in the drawings may not be illustrated to scale but may be exaggerated.

It will be understood that, although the terms "first", "second", etc. used herein may be used to describe various elements, these elements should not be limited by these terms. These terms are only used to distinguish one element from another.

The terminology used herein is for the purpose of describing particular embodiments only and is not intended to limit the scope of rights of the invention. As used herein, the singular forms "a," "an," and "the," are intended to include the plural forms as well, unless the context clearly indicates otherwise. It will be further understood that the terms "includes", "comprises," etc., when used herein, specify the presence of stated features, integers, steps, operations, elements, components and/or combinations thereof, but do not preclude the presence or addition of one or more other features, integers, steps, operations, elements, components, and/or combinations thereof.

A typical dishwasher will now be described in detail with reference to FIG. 1. FIG. 1 is a schematic view diagrammatically illustrating the internal structure of the typical dishwasher.

Referring to FIG. 1, the dishwasher 100 includes a case 120 defining the appearance of the dishwasher 100, a tub 130 disposed in the case 120, which defines a washing space, in which dishes are washed, and which has a dish-introduction port formed in the front surface thereof, a door 122 for opening and closing the dish-introduction port of the tub 130, a drive unit 140 provided at a lower portion of the tub 130 so as to supply, collect, circulate and discharge wash water for washing dishes, a plurality of racks 200, 150 and 160, which are detachably mounted in the tub 130 and on which dishes are placed, and a plurality of spray units 134, 133 and 132, which are respectively provided near the plurality of racks 200, 150 and 160 so as to spray wash water for washing dishes.

Here, among the components of the dishwasher 100, the tub 130, the drive unit 140 and the spray units may be embodied into configurations which are identical or similar to those of the conventional art. Accordingly, detailed descriptions of such configurations are omitted herein.

The plurality of racks 200, 150 and 160 are configured so as to be drawn toward the opening in the tub 130 from the inside of the tub 130. The plurality of racks includes a first rack 200, which is disposed at a lower level of the tub 130 so as to receive relatively large dishes, a second rack 150, which is disposed over the first rack 100 so as to receive relatively small dishes, and a third rack 160, which is disposed at an upper level of the tub 130 so as to receive dishes and the like.

The first rack 200 of the dishwasher 100 includes a frame 210 defining a space for receiving dishes, a plurality of fixed guides 220, which are provided in the frame 210 so as to support dishes in fixed state, and moving casters, which are provided at opposite side ends of the frame 210 so as to support the frame 210 in a movable manner.

Here, the frame 210 may be configured to have a grille shape, in which metal wires intersect each other in a mesh pattern. Specifically, since the frame 210 is configured to have a grille shape, the wash water sprayed from the lower spray unit 134 or the upper spray unit 133 may be efficiently transferred to the dishes received in the first rack 200.

The frame 210 may include a surrounding frame 211, an anteroposterior frame 212 and a transverse frame 217.

The surrounding frame 211 may be configured to have a horizontal continuous ring shape, in which one or more frames are connected to each other. The surrounding frame 211 includes a lower wire 211*a* positioned at the lowermost level, and an upper wire 211*b* positioned over the lower wire 211*a*. Some portions of the lower wire 211*a* and the upper wire 211*b* extend in the drawing direction of the first rack 200.

The anteroposterior frame 217 may extend in the drawing direction of the first rack 200, and may be connected to the surrounding frame 211. The anteroposterior frame 217 includes outer wires 217*a*, disposed at opposite lateral sides of the frame 210, and intermediate wires 217*b* disposed between the lateral wires 217*a*. Some portions of the outer wires 217*a* and the intermediate wires 217*b* extend in the drawing direction of the first rack 200.

The transverse frame 212 is oriented so as to perpendicularly intersect the anteroposterior frame 217. The transverse frame 212 may be connected to the surrounding frame 211 and the anteroposterior frame 217.

One or more of the surrounding frame 211, the transverse frame 212 and the anteroposterior frame 217 may be wholly or partially omitted. The material and shape of the frame 210 are not limited to those mentioned above. Even if the frame 210 is differently configured to have a configuration other than the above-mentioned configuration of the frame 210, the frame 210 having the different configuration may be considered to be the frame 210 according to the present invention as long as it can store dishes.

The plurality of spray units 134, 133 and 132 are constructed so as to spray wash water to dishes and the like received in the respective racks 200, 150 and 160. The plurality of spray units 134, 133 and 132 include a lower spray unit 134, which is disposed at a lower portion of the tub 130 so as to spray wash water to the first rack 200, an upper spray unit 133, which is disposed between the first rack 200 and the second rack 150 so as to spray wash water to the first and second racks 200 and 150, and a top spray unit 132, which is disposed at an upper portion of the tub 130 so as to spray wash water to the second rack 150 or the third rack 160.

The tub 130 is provided at opposite lateral side walls thereof with rails for guiding drawing and introduction of the first to third racks 200, 150 and 160. The rails may include fixed guide rails 152, each of which is configured to a simple rail shape for guiding drawing and introduction of the first rack 200, and extensible guide rails 151, which are extended in accordance with drawing of the second and third racks 150 and 160 so as to guide drawing and introduction of the second and third racks 150 and 160. The guide rail that will be described hereinafter, is the fixed guide rail 152.

The tub 130 includes separation-prevention members 153 provided at opposite lateral side walls thereof. The separation-prevention members 153 are disposed over inner portions of the guide rails 152 so as prevent upward separation of the moving casters 219.

The separation-prevention members 153 project from the opposite side walls of the tub 130 at a position spaced apart and upwards from the rear ends of the fixed guide rails 152 upward. One of the moving casters 219 of the first rack 200, which is positioned at the rear end of the first rack 200, is moved through the front end of the guide rail 152 when the first rack 200 is introduced into the tub. Upon completion of the introduction of the first rack 200, the one of the moving casters 219 is positioned between the rear end of the fixed guide rail 152 and the separation-prevention member 153. The separation-prevention member 153 is provided at one end thereof with a reinforcing rib 154, which extends forward.

The moving casters 219 are positioned at opposite lateral sides of the frame 210, based on the drawing direction of the frame 210. The moving casters 219 are preferably provided at front and rear ends of one of the surrounding frame 211 and the anteroposterior frame 217, which is positioned at the lateral sides. For support of the moving casters 219, caster frames 218 may be connected to the surrounding frame 211 or to the anteroposterior frames 217. The moving casters 219 may be rotatably coupled to the lower ends of the caster frames 218.

The moving casters 219 may be movably mounted on the fixed guide rails 152 provided at lower regions of the internal surface of the tub 130. The moving casters 219 may be supported by the upper surface of the opened door 122 after completion of the drawing of the first rack 200. The moving casters 219 may be constructed in accordance with various embodiments, and a detailed description thereof is omitted herein.

Each of the plurality of fixed guides 220 is connected at an end thereof to a predetermined portion of the transverse frame 212 or the anteroposterior frame 217, the guides being spaced apart from each other at predetermined intervals.

The door 122 is intended to open and close the dish introduction port formed in the front surface of the tub 130. Generally, the door 122 includes a hinge member (not shown), which is provided at the bottom of the dish introduction port so as to allow opening and closing of the door 122. The door 122 opens about the hinge member, which serves as a rotating shaft.

The door 122 is provided on the external surface thereof with a handle (not shown) for opening and closing the door and a control panel (not shown) for controlling the dishwasher 100. The internal surface of the door 122 defines one internal surface of the tub 130 when the door 122 is closed, and defines a mounting surface 125 on which the first rack 200 is mounted when the door 122 is opened. To this end, it is preferable for the mounting surface 125 of the door 122 to define a horizontal surface extending from the fixed guide rails 152, along which the first rack 200 is guided, when the door is opened.

The dishwasher 100 is packaged with one of various kinds of shock absorbers before loading and transportation in order to transfer the dishwasher 100 to a consumer in the state in which the characteristics and value of the dishwasher product at the time of original manufacture of the product are preserved. In other words, the shock absorber, which is used to package the dishwasher 100, is intended to protect the dishwasher 100 from external shocks, thereby preventing the dishwasher 100 from being scratched or crushed and preventing contamination of the dishwasher 100 with various external foreign substances.

The first to third racks 200, 150 and 160 are transported in the state of being mounted in the tub 130 upon release of the dishwasher from a factory. In this regard, because there are gaps between the first to third racks 200, 150 and 160 and the tub 130, the first to third racks 200, 150 and 160 may collide with and scratch the internal surface of the door 122 while moving in the tub 130 during transportation. In order to prevent the occurrence of scratches attributable to such a collision, a shock absorber is disposed between the first to third racks 200, 150 and 160 and the tub 130.

Hereinafter, the shock absorber 300 according to an embodiment of the present invention will be described in detail with reference to FIGS. 4 and 5.

Figure 2:
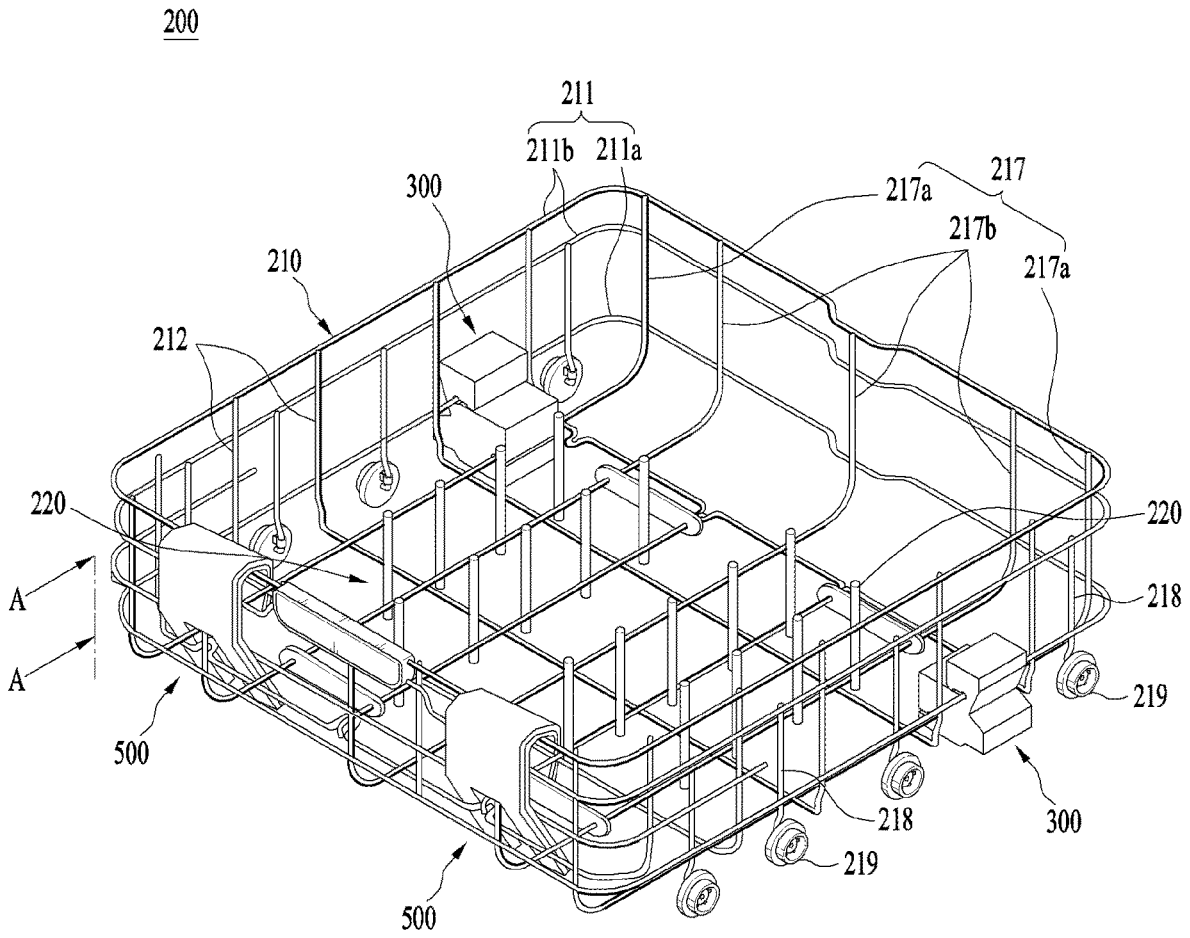
FIG. 2 is a perspective view illustrating a shock absorber according to various embodiments of the present invention, which is coupled to a rack shown in FIG. 1.
Figure 3:
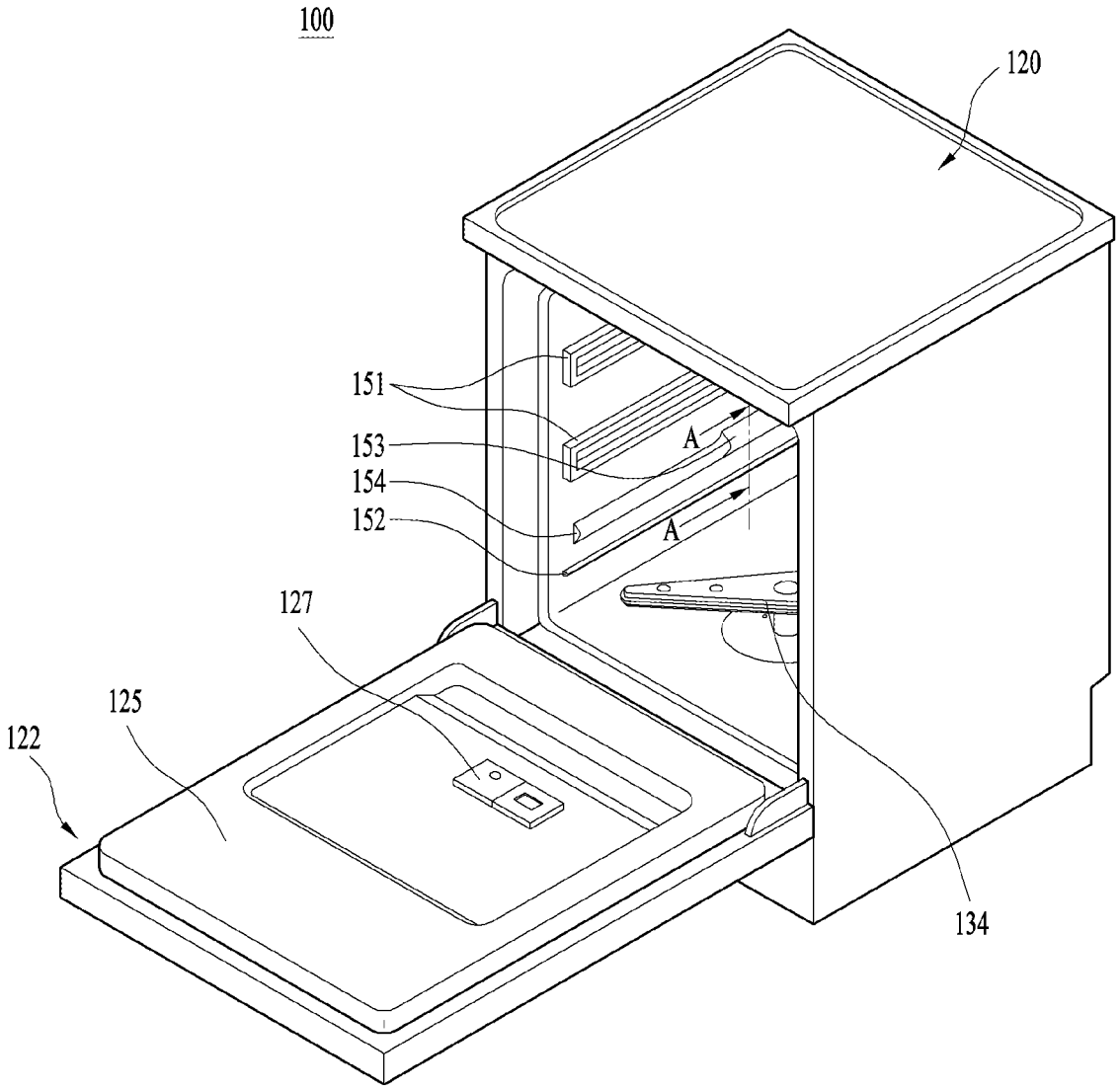
FIG. 3 is a perspective view illustrating the internal structure of a tub in the dishwasher shown in FIG. 1.
Figure 4:
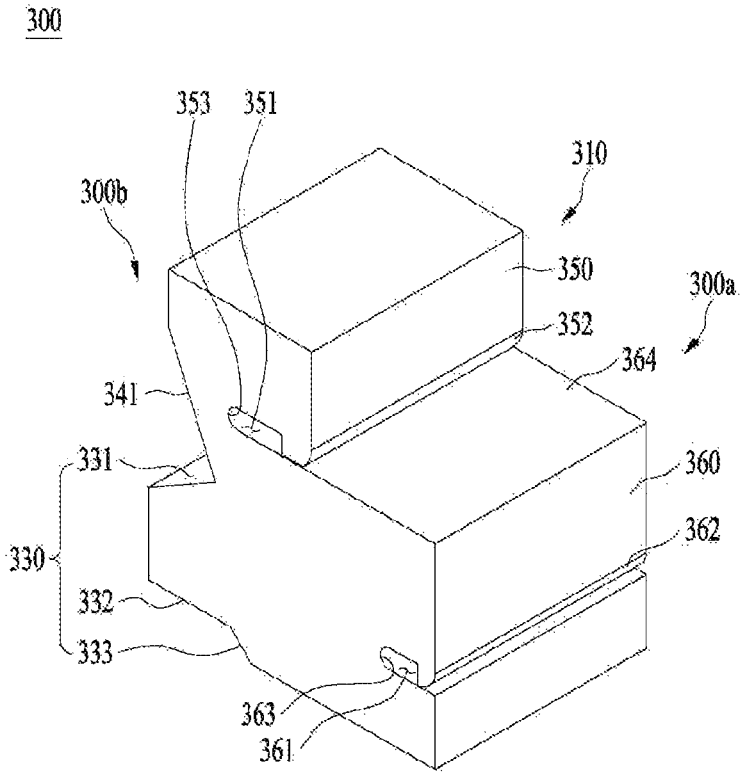
FIG. 4 is a perspective view illustrating the shock absorber according to an embodiment of the present invention, which is shown in FIG. 2.

FIG. 4 is a perspective view illustrating the shock absorber 300 according to the embodiment of the present invention shown in FIG. 2. FIG. 5 is a cross-sectional view taken along line A-A of FIG. 2, which illustrates the shock absorber 300 according to the embodiment of the present invention, disposed between the rack and the tub.

Figure 5:
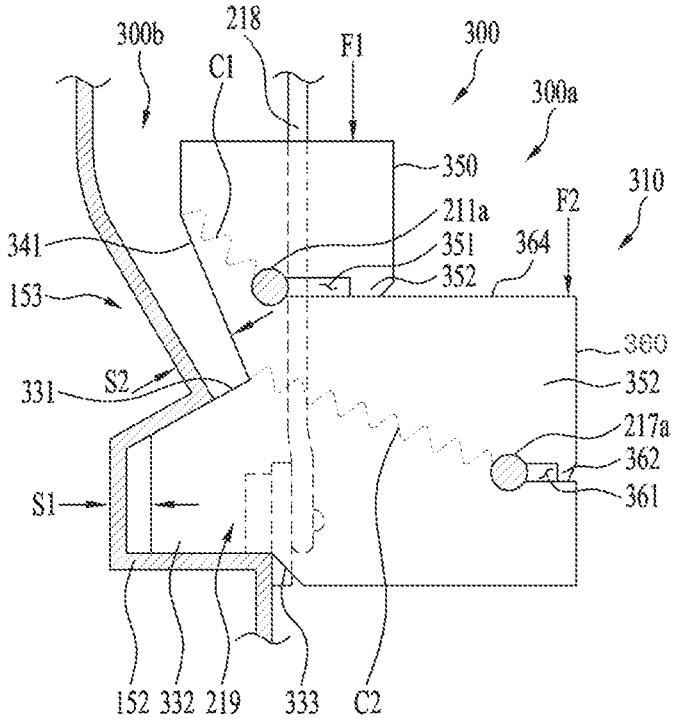
FIG. 5 is a cross-sectional view taken along line A-A of FIG. 2, which illustrates the shock absorber according to the present invention, disposed between the rack and the tub and coupled to the rack.

Although only the shock absorber 300, which is used for the first rack 200, is illustrated in FIGS. 4 and 5, the figures illustrate only one example to which the shock absorber 300 is applied, and the shock absorber 300 illustrated in FIGS. 4 and 5 may also be selectively applied to the second rack 150 and the third rack 160. Hereinafter, the term "rack", as used herein, indicates the first rack 200 unless otherwise specially mentioned.

Referring to FIGS. 4 and 5, the shock absorber 300 according to the embodiment of the present invention is coupled to opposite lateral side ends of the first rack 200, and presses and supports the internal surface of the tub 130 so as to prevent vertical movement of the rack 200. Particularly, in the case in which the internal surface of the tub 130 is configured to have a specific shape, the shock absorber 300 is configured to have a shape corresponding to the specific shape so as to press and support the internal surface of the tub 130 for the purpose of increasing the frictional force therebetween.

The shock absorber 300 includes a body defining the appearance thereof, receiving grooves 351 and 361, which are provided in one side surface of the body 310 so as to receive one lateral side of the rack 200, and a pressing portion 330, which is provided at the other side surface of the body 310 so as to press and support one side of the tub 130 and thus to press the body 310 downward.

The body 310 is made of flexible material having elasticity. The body 310 includes a first side part, that is, an inner part 300*a*, which faces the rack 200, and a second side part, that is, an outer part 300*b*, which faces the internal surface of the tub 130 and is positioned opposite the first side part. The outer part 300*b* includes the pressing portion 330, and the inner part 300*a* includes the receiving grooves 351 and 361.

The pressing portion 330 is configured to have a protrusion shape projecting from the outer part 300*b* so as to be fitted between the separation-prevention member 153 and the guide rail 152 in an interference-fit manner. The pressing portion 330 includes an upper inclined surface 331, a mounting surface 332 and a lower inclined surface 333.

The upper inclined surface 331 is formed at the upper side of the pressing portion 330 and is inclined downward moving away from the body 310. Accordingly, as the pressing portion 330 is pressed toward the internal surface of the tub 130, the shock absorber 300 is pressed downward due to interference with the lower surface of the separation-prevention member 153, thereby preventing the shock absorber 300 from being separated upward.

The mounting surface 332 is formed at the lower side of the pressing portion 330 so as to be brought into contact with the upper surface of the guide rail 152, and is thus configured to have a shape corresponding to the upper surface of the guide rail 152. For example, the mounting surface 332 may be formed into an approximately horizontal surface. As a result, it is possible to prevent the shock absorber 300 from being separated downwards from the guide rail 152 by virtue of the mounting surface 332.

The lower inclined surface 333 is formed at the lower side of the pressing portion 330, and is inclined downward moving in the inward direction of the body 310 from the inner end of mounting surface 332 opposite the outer end of the mounting surface 332. Consequently, when external force is applied to the shock absorber 300 in a direction toward the internal surface of the tub 130 due to shaking of the dishwasher, the pressing portion 330 is compressed. At this time, the lower inclined surface 333 is moved toward the guide rail 152, and is thus pressed upward due to interference with the guide rail 152. Accordingly, as external force is applied to the shock absorber 300 in the direction of the internal surface of the tub 130, the shock absorber 300 is held increasingly firmly on the internal surface of the tub 130.

Since the pressing portion 330 is provided at the outer part 300*b*, the outer part 300*b* is provided with an outer inclined surface 341, which is inclined upward toward the outward direction of the body 310. The outer inclined surface 341 is configured to have a shape corresponding to the upper surface of the separation-prevention member 153 so as to prevent the wire from being separated from the first receiving groove 351 when the upper portion of the body 310 is bent toward the tub 130 due to the application of external force. Consequently, the gap between the outer inclined surface 341 and the upper surface of the separation-prevention member 153 is reduced. Hence, even when the body 310 is bent toward the tub 130, the outer inclined surface 341 interferes with the upper surface of the separation-prevention member 153, thereby preventing the body 310 from being excessively bent and preventing the wire from being separated from the first receiving groove 351.

The receiving grooves 351 and 361 may include at least two receiving grooves so as to prevent the shock absorber 300 from being rotated about one side of the rack 200 when the one side of the rack 200 is fitted into the shock absorber 300 so as to couple the shock absorber 300 to the rack 200.

The receiving grooves 351 and 361 may include a first receiving groove 351 and a second receiving groove 361, but the present invention is not limited thereto. In consideration of disposition of the wires and the like, the receiving grooves may include at least three receiving grooves.

The receiving grooves 351 and 361 are configured to receive a wire, which is disposed in a direction perpendicular to direction of gravity and is approximately parallel to the ground, so as to withstand the downward force that is applied to the shock absorber 300 by the pressing portion 330. The reason for this is that, when the receiving groove is configured to receive a wire, which is disposed to be perpendicular to the ground, the shock absorber 300 may slip down along the wire.

Specifically, the first receiving groove 351 is formed in the inner part 300*a* of the body 310 so as to have an elongate groove shape extending in a direction approximately parallel to the upper end of the body 310. The second receiving groove 361 is formed in the inner part 300*a* of the body 310 so as to have an elongate groove shape extending in a direction approximately parallel to the lower end of the body 310.

The first receiving groove 351 and the second receiving groove 361 may be configured to have sufficient length to accommodate wires, which are variously disposed in consideration of the overall placement of the rack 200.

The first receiving groove 351 receives, for example, the lower wire 211*a* of the surrounding frame 211, and the second receiving groove 361 receives, for example, the outer wire 217*a* of the anteroposterior frame 217.

The inner part 300*a* of the body 310 may include a first inner surface 350, which faces the rack 200, and a second inner surface 360, which defines a stepped shape with respect to the first inner surface 350 and faces the rack 200. Accordingly, the first receiving groove 351 may be formed in the first inner surface 350 facing the outer part 300*b* of the body 310, and the second receiving groove 361 may be formed in the second inner surface 360 facing the outer part 300*b* of the body 310.

Here, the second inner surface 360 projects further from the inner part 300*a* than the first inner surface 350. Accordingly, in the case where the lower wire 211*a* is positioned to be outwardly spaced apart from the outer wire 217*a*, the amount of material required to make the shock absorber 300 is reduced, compared to a shock absorber without such a stepped structure.

The body 310 is provided with a guide surface 364 so as to allow the wires to be easily fitted into the first receiving groove 351 and the second receiving groove 361. The guide surface 364 extends to the first inner surface 350 from the upper end of the second inner surface 360. Accordingly, a user may dispose the lower wire 211*a* on the guide surface 364 and may insert the lower wire 211*a* into the first receiving groove 351 in the guide surface 364. Subsequently, the user may insert the outer wire 217*a* into the second receiving groove 361.

In this case, the bottom surface of the first receiving groove 351 is configured to be the same surface as the guide surface 364 such that the lower wire 211*a* is smoothly inserted into the first receiving groove 351 along the guide surface 364 without interference with an object such as a protrusion after disposition of the lower wire 211*a* on the guide surface 364.

Because the lower wire 211*a* is first inserted into the first receiving groove 351 and the outer wire 217*a* is then inserted into the second receiving groove 361, the first receiving groove 351 is formed to be deeper than the second receiving groove 361.

When downward forces F1 and F2 are respectively applied to portions of the body 310 defining the first receiving groove 351 and the second receiving groove 361, the entrances of the receiving grooves become narrow. Hence, a first crack C1 and a second crack C2 may be generated at a first end portion 352 of the first receiving groove 351 and a second end portion of the second receiving groove 361, which are positioned opposite the entrances of the corresponding receiving grooves. In order to prevent the generation of such cracks, the first receiving groove 351 and the second receiving groove 361 are respectively provided with a first support 352 and a second support 362, which project from the upper or lower surfaces of the entrances of the first and second receiving grooves 351 and 361.

In order to allow easy insertion of the wires into the receiving grooves, the first support 352 and the second support 362 are configured such that the outer surfaces thereof are inclined inward and downward.

The shock absorber 300 is configured such that the surfaces other than the upper inclined surface 331 and the mounting surface 332 are spaced apart from the inner surface of the tub when the shock absorber 300 is mounted on the rack 200. The reason for this is to allow the rack 200 with the shock absorber 300 mounted thereon to be easily drawn from and introduced into the tub 130. As illustrated in FIG. 5, for example, the vertical surface between the upper inclined surface 331 and the mounting surface 332 is spaced apart from the inner surface of the tub 130 by a gap S1, and the outer inclined surface 341 is spaced apart from the upper surface of the separation-prevention member 153 by a gap S2.

Hereinafter, coupling and operation of the shock absorber 300 according to an embodiment of the present invention will be described in detail.

A user draws the rack 200 out of the tub 130, and disposes the lower wire 211*a* on the guide surface 364 of the shock absorber 300. Subsequently, the user inserts the lower wire 211*a* into the first receiving groove 351 toward the outer part 300*b* of the shock absorber 300 along the guide surface 364.

After the lower wire 211*a* is inserted into the first receiving groove 351 to some extent, the outer wire 217*a* is inserted into the second receiving groove 361, thereby completing the coupling of the shock absorber 300 to the rack 200.

Thereafter, when the rack 200 with the shock absorber 300 mounted thereon is introduced into the tub 130, the pressing portion of the shock absorber 300 is fitted between the separation-prevention member 153 and the guide rail 152 in an interference-fit manner. Accordingly, even when the distance between the two inner surfaces of the tub 130 are increased, vertical movement of the rack 200 is prevented.

Thereafter, when force is applied to the shock absorber 300 in the direction of the inner surface of the tub 130 due to shaking of the dishwasher during transportation, the interference fit between the inner surface of the tub 130 and the shock absorber 300 become firmer.

Hereinafter, a shock absorber 500 according to another embodiment of the present invention will be described in detail with reference to FIGS. 6 to 8.

Figure 6:
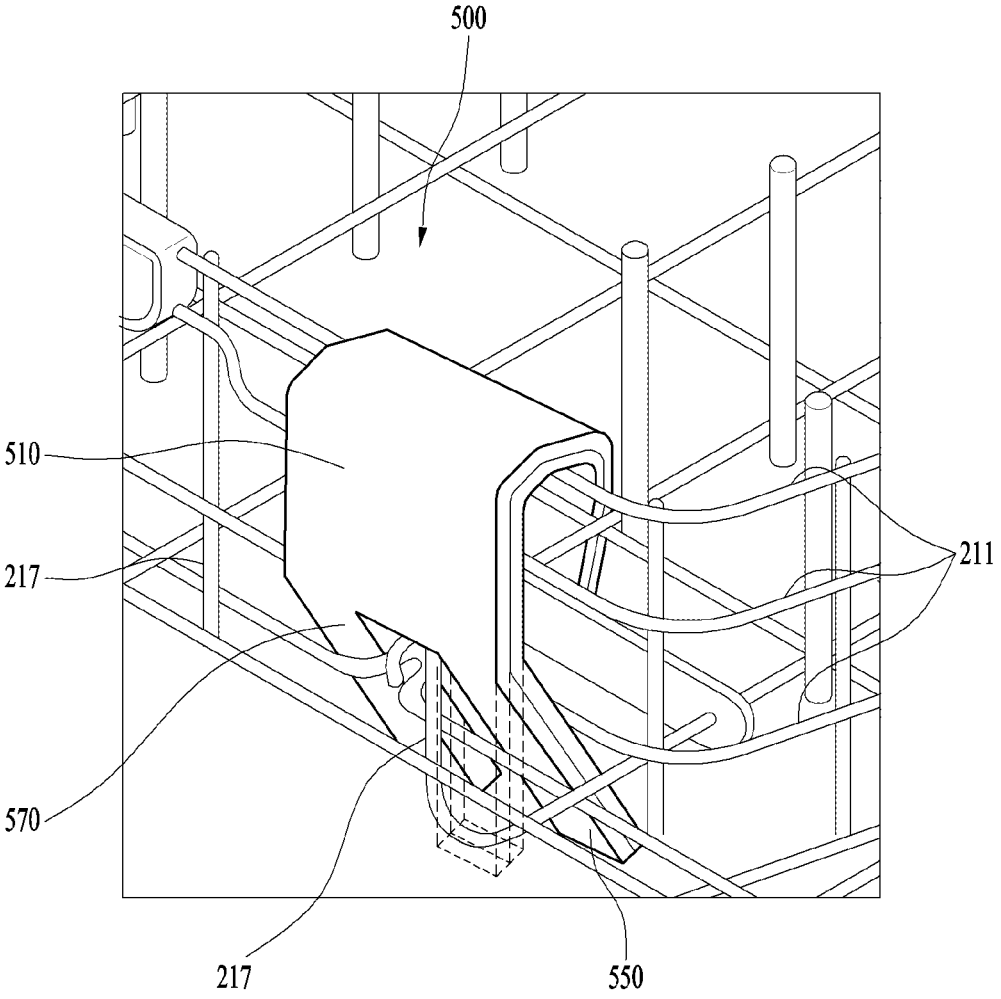
FIG. 6 is a perspective view illustrating the shock absorber, coupled to the rack, according to another embodiment of the present invention, which is shown in FIG. 2.

FIG. 6 is a perspective view illustrating the shock absorber according to another embodiment of the present invention, coupled to the rack, which is also illustrated in FIG. 2. FIGS. 7 and 8 are perspective views illustrating an operation of coupling the shock absorber.

Figure 7:
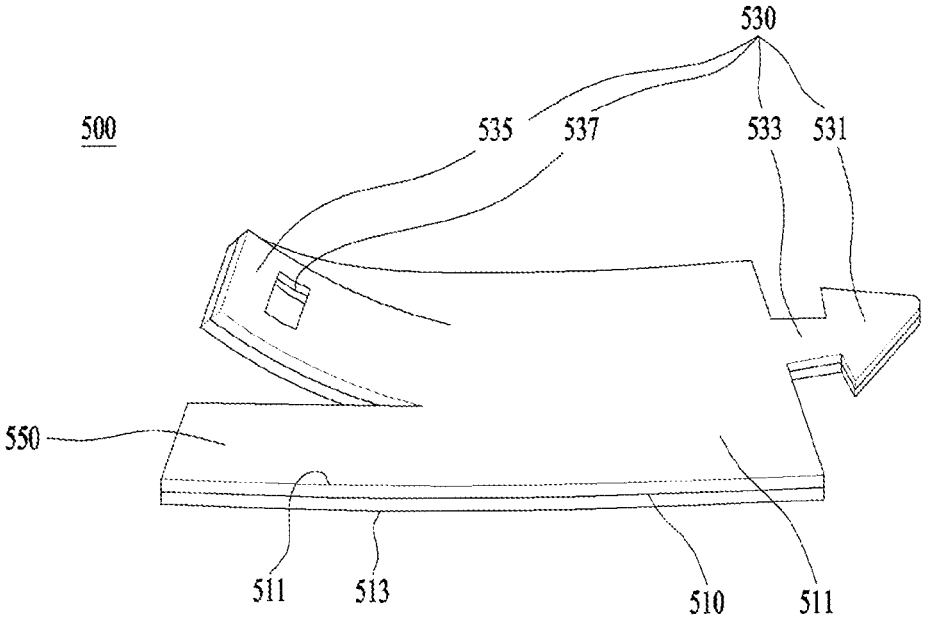
FIGS. 7 and 8 are views illustrating an operation of coupling the shock absorber shown in FIG. 6.
Figure 8:
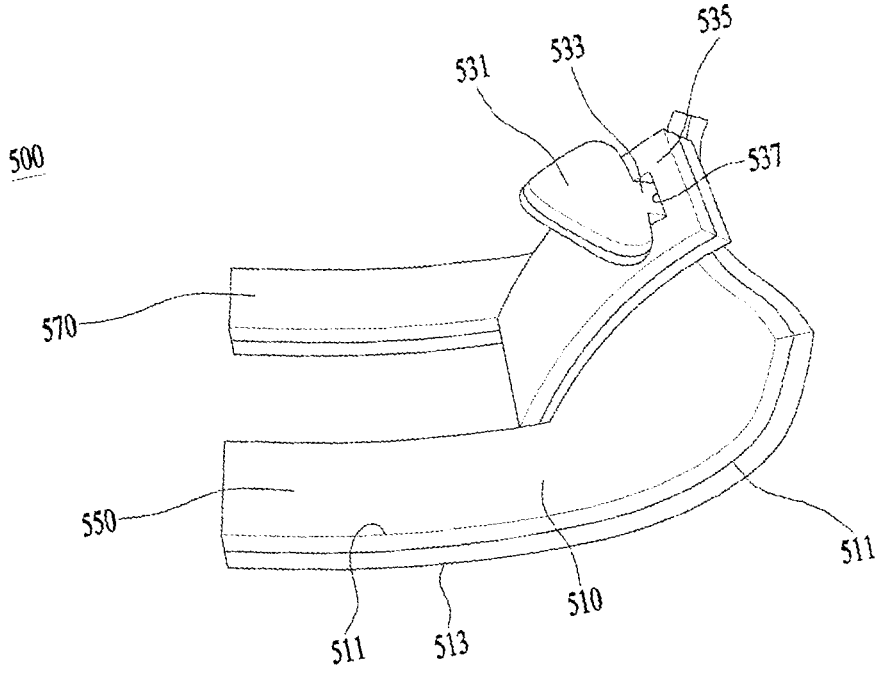

Although FIGS. 6 to 8 illustrate the shock absorber 500 that is used for the first rack 100, the shock absorber 500 illustrated in FIGS. 6 to 8 may be selectively applied to the second rack 150 and the third rack 160, other than the first rack 200. Accordingly, although this embodiment illustrates the shock absorber 500 coupled to the first rack 200, the illustration is only an example.

Referring to FIG. 6, the shock absorber 500 according to this embodiment of the present invention is coupled to the front surface of the first rack 200 in such a manner as to surround the uppermost wire among the wires constituting the surrounding frame 211. Since one side of the shock absorber 500 comes into contact with the inner surface of the door 122 such that a rough-cut surface of the first rack 200 does not come into contact with the inner surface of the door 122, it is possible to minimize the occurrence of scratches on the inner surface of the door 122. In addition, when the surrounding frame 211 has a protruding or rough portion, the shock absorber 500 may surround the protruding or rough portion, thereby minimizing the occurrence of scratches on the inner surface of the door 122.

The shock absorber 500 includes a body 510, which is flexible so as to surround one side of the rack, a coupling unit 530 for coupling opposite ends of the body 510 to each other, and a plurality of shock-absorbing legs 550 and 570, which are provided at one end of the body 510 so as to be independently coupled to the rack.

The body 510 is configured to have a plate shape and is made of flexible material. Consequently, when the shock absorber 500 is coupled to the first rack 200 by means of the coupling unit 530, the body 510 is bent so as to surround the uppermost wire of the surrounding frame 211 of the first rack 200.

The coupling unit 530 includes a coupling leg 535 provided at one end of body 510, a coupling hook 531, which is provided at the other end of the body 510 and which is selectively coupled to the coupling leg 535, and an extension 533 connecting the coupling hook 531 to the body 510.

The coupling hook 531 is configured to have a triangular shape and is inserted into a coupling hole 537, which will be described later. The coupling hook 531 is made of flexible material and is sized to be smaller than the coupling hole 537 so as to be inserted into the coupling hole 537. Consequently, it is possible to increase the coupling force by virtue of coupling between the coupling hook 531 and the coupling hole 537. A snap fit is established between the coupling hook 531 and the coupling hole 537.

The coupling leg 535 is provided at the center of one end of the body 510, and has the coupling hole 537 into which the coupling hook 531 is inserted. The coupling leg 535 extends from the body 510 outward, and is made of flexible material. Consequently, when the coupling leg 535 is coupled to the coupling hook 531, the coupling leg 535 surrounds the uppermost wire of the surrounding frame 211 in a bent state.

The extension 533 is configured to have a section area such that it is smaller than that of the coupling hook 531 and to be equal to or smaller than the size of the coupling hole 537. When the opposite ends of the body 510 are coupled to each other by means of the coupling unit 530, the extension 533 is disposed in the coupling hole 537.

The plurality of shock-absorbing legs 550 and 570 include a first shock-absorbing leg 550 and a second shock-absorbing leg 570. The coupling leg 535 is provided between the first shock-absorbing leg 550 and the second shock-absorbing leg 570. In other words, the first shock-absorbing leg 550 and the second shock-absorbing leg 570 are provided at both lateral sides of the one end of the body 510. Although FIGS. 6 to 8 illustrate only the first shock-absorbing leg 550 and the second shock-absorbing leg 570, the present invention is not limited thereto. The body 510 may further include an additional shock-absorbing leg other than the first shock-absorbing leg 550 and the second shock-absorbing leg 570.

The first shock-absorbing leg 550 and the second shock-absorbing leg 570 may be independently bent with respect to the body 510. Accordingly, when the body 510 is coupled by means of the coupling unit 530 so as to surround the uppermost wire of the surrounding frame 211, the first shock-absorbing leg 550 and the second shock-absorbing leg 570 may be selectively bent so as to be inserted into the first rack 200.

Specifically, the first shock-absorbing leg 550 and the second shock-absorbing leg 570 are selectively bent and are then inserted between the uppermost wire and the next lower wire of the surrounding frame 211.

Thereafter, the first shock-absorbing leg 550 and the second shock-absorbing leg 570 press the next lower wire in the outward direction of the first rack 200 due to the elasticity thereof. Accordingly, when the shock absorber 500 is coupled to the first rack 200, the shock absorber 500, which surrounds the uppermost wire of the surrounding frame 211, cannot be rotated.

The shock absorber 500 may be coupled to the first rack 200 such that one wire of the anteroposterior frame 217 is disposed between the first shock-absorbing leg 550 and the second shock-absorbing leg 570.

The reason why the shock absorber 50 is provided with a plurality of shock-absorbing legs, such as the first shock-absorbing leg 550 and the second shock-absorbing leg 570, which are independently bent and inserted into the first rack 200, is because dishwashers may be provided with various racks having different shapes and the shock-absorber 500 may be coupled to different locations on the first rack 200.

For example, when the wires of the anteroposterior frame 217, to which the shock absorber 500 is coupled, are densely arranged, only one of the first shock-absorbing leg 550 and the second shock-absorbing leg 570 may be inserted into the first rack 200.

In addition, when the shock absorber 500 is coupled to a marginal region of the first rack 200, there is the case where it is impossible to insert both the first shock-absorbing leg 550 and the second shock-absorbing leg 570 into the first rack 200. In this case, only one of the first shock-absorbing leg 550 and the second shock-absorbing leg 570 may be inserted into the first rack 200.

When at least one of the first shock-absorbing leg 550 and the second shock-absorbing leg 570 is inserted into the first rack 200, a wire of the anteroposterior frame 217 interferes with the inserted one of the first shock-absorbing leg 550 and the second shock-absorbing leg 570. Consequently, even when external force is applied to the dishwasher during transportation, the shock absorber 500 cannot slip from the initial coupling location thereof due to interference between the shock absorber 500 and a wire of the anteroposterior frame 217.

The shock absorber 500 may be integrally made of one kind of material. In other words, all of the components of the shock absorber 500 may be integrally made of a flexible material.

Conventionally, a member made of PE material or the like has been attached to a region on the rack that comes into contact with the inner surface of the door 122. By virtue of the shock absorber 50, since a rough-cut surface of the rack does not contact the inner surface of the door 122, there is no need to provide such a member made of PE material. Therefore, expense incurred to produce the shock absorber 500 may be reduced, and the durability of the shock absorber 500 may be improved.

Meanwhile, the shock absorber 500 may be integrally made of double-layered materials. Specifically, the shock absorber may include a first member, which contacts the first rack at one surface thereof, and a second member contacting the other surface of the first member.

In this case, since the material of the second member is softer than the material of the first member, it is possible to greatly reduce the incidence of scratches on the inner surface of the door by virtue of the second member contacting the inner surface of the door. In contrast, the first member may be made of rigid material having the rigidity required of the shock absorber.

Accordingly, the body of the shock absorber 500 is also made of double-layered materials. That is, the body of the shock absorber 500 may include a first body (511) corresponding to the first member and a second body (513) corresponding to the second member.

Hereinafter, coupling and operation of the shock absorber 500 according to this embodiment of the present will be described in detail.

Because the shock absorber 500 is composed of the flexible body 510, the body 510 is bent when the coupling hook 531 of the coupling unit 530 is coupled to the coupling leg 535. By employing this property of the shock absorber 500, the shock absorber 500 may be coupled to the first rack 200 in such a manner as to surround the uppermost wire of the surrounding frame 211.

Subsequently, at least one of the first shock-absorbing leg 550 and the second shock-absorbing leg 570 is inserted into the first rack 200.

As a result, the shock absorber 500, which is coupled to the first rack 200, does not rotate on the first rack 200 and does not slip along the wire of the frame.

In addition, a rough-cut surface of the shock absorber 500 does not face the inner surface of the door 122, and a smooth and soft surface of the shock absorber 500 comes into contact with the inner surface of the door 122. Accordingly, it is possible to minimize the occurrence of scratches on the inner surface of the door 122.

Furthermore, since the first shock-absorbing leg 550 and the second shock-absorbing leg 570 are spaced apart from each other with the coupling leg 535 interposed therebetween, the shock absorber 500 may be coupled to racks having various shapes.

As is apparent from the above description, the present invention advantageously provides a shock absorber and a dishwasher including the shock absorber, in which the shock absorber is firmly coupled to a rack in the dishwasher and thus there is no concern of the shock absorber being separated from the rack during transportation.

Furthermore, the present invention advantageously provides a shock absorber and a dishwasher including the shock absorber, in which the shock absorber is coupled to a lateral side surface of a rack in the dishwasher so as to fundamentally prevent the occurrence of scratches on the inner surface of the door of the dishwasher.

In addition, the present invention advantageously provides a shock absorber and a dishwasher including the shock absorber, in which one surface of the shock absorber, which comes into contact with the inner surface of the door of the dishwasher, is made of soft material so as to minimize the occurrence of scratches on the inner surface of the door and the other surface of the shock absorber is made of rigid material having the rigidity required of the shock absorber.

Although the present invention has been described with reference to several specific embodiments and drawings, the present invention is not limited to the embodiments and drawings. It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A shock absorber for a dishwasher having a tub comprising a separation-prevention member protruding from an inner surface of the tub, and a rack provided inside the tub and comprising moving casters configured to facilitate a movement of the rack, the shock absorber comprising:

a body;

one or more receiving grooves in a first side surface of the body, the one or more receiving grooves configured to receive a portion of the rack; and a pressing portion provided on a second side surface of the body opposite to the first side surface, the pressing portion configured to exert a downward force on the body in response to being pressed against a portion of the tub, wherein the separation-prevention member is configured to confine a movement of the moving casters in an upward direction and to contact the pressing portion, and wherein the pressing portion is configured to press a lower portion of the separation-prevention member in the upward direction.

2. The shock absorber according to claim 1, wherein the pressing portion comprises an upper inclined surface provided at an upper portion of the pressing portion, the upper inclined surface extending outwardly and downwardly from the second side surface of the body.

3. The shock absorber according to claim 2, wherein the tub further comprises a guide rail configured to guide the moving casters, and wherein the pressing portion further comprises:

a mounting surface provided at a lower portion of the pressing portion, the mounting surface configured to be mounted on the guide rail; and a lower inclined surface extending inwardly and downwardly from the mounting surface toward the first side surface of the body.

4. The shock absorber according to claim 2, wherein each of the one or more receiving grooves comprises a support protruding from an upper surface or a lower surface at an entrance of the respective receiving grooves, the support configured to mechanically support the lower surface or the upper surface.

5. The shock absorber according to claim 1, wherein the one or more receiving grooves are at least two receiving grooves, and wherein the at least two receiving grooves are configured to restrict rotation of the body.

6. The shock absorber according to claim 5, wherein the rack comprises a plurality of wires arranged in a moving direction of the rack, and wherein the at least two receiving grooves are configured to receive the plurality of wires.

7. The shock absorber according to claim 6, wherein the first side surface of the body comprises:

a first inner surface; and a second inner surface protruding further from the second side surface than the first inner surface, and wherein the at least two receiving grooves comprise:

a first receiving groove on the first inner surface; and a second receiving groove on the second inner surface.

8. The shock absorber according to claim 7, wherein the body comprises a guide surface extending from an upper end of the second inner surface toward the first inner surface, and wherein the guide surface provides a lower surface of the first receiving groove.

9. The shock absorber according to claim 5, wherein the first side surface of the body comprises:

a first inner surface; and a second inner surface protruding further from the second side surface than the first inner surface, and wherein the at least two receiving grooves comprise:

a first receiving groove on the first inner surface; and a second receiving groove on the second inner surface.

10. The shock absorber according to claim 9, wherein the first inner surface is positioned higher than the second inner surface.

11. The shock absorber according to claim 9, wherein the body comprises a guide surface extending from an upper end of the second inner surface toward the first inner surface, and wherein the guide surface provides a lower surface of the first receiving groove.

* * * * *